United States Patent [19]

Troncone et al.

[11] Patent Number: 4,979,250

[45] Date of Patent: Dec. 25, 1990

[54] BLANKET FOR A NEWBORN INFANT

[76] Inventors: Jeanelle N. Troncone; Gregory A. Troncone, both of 10839 Eldora Ave., Sunland, Calif. 91040

[21] Appl. No.: 425,065

[22] Filed: Oct. 23, 1989

[51] Int. Cl.[5] ..... A47G 9/06

[52] U.S. Cl. ..... 5/494; 5/482; 2/69

[58] Field of Search ..... 5/413, 482, 494; 2/69, 2/69.5

[56] References Cited

U.S. PATENT DOCUMENTS

| | | | |
|---|---|---|---|
| 965,921 | 8/1910 | Mercey | 5/413 X |
| 1,584,853 | 5/1926 | Dern | 2/69 |
| 1,639,156 | 8/1927 | Wilmert | 5/494 X |
| 2,227,751 | 1/1941 | Idelman | 2/69.5 |
| 2,441,745 | 5/1948 | Benamy | 2/69 |
| 3,412,407 | 11/1968 | Key | 2/69.5 |
| 3,739,399 | 6/1973 | Sheahon | 2/69.5 |

FOREIGN PATENT DOCUMENTS

| | | | |
|---|---|---|---|
| 1405124 | 9/1975 | United Kingdom | 5/494 |

*Primary Examiner*—Michael F. Trettel
*Attorney, Agent, or Firm*—Beehler & Pavitt

[57] ABSTRACT

A blanket and method for swaddling an infant is provided that is both physically and psychologically simulative of the snug encapsulization experienced by the infant when in utero. The blanket is comprised of an upper portion having two symmetric wings. Each wing has a shape and a size sufficient to be wrapped over the shoulder and arm of the infant in front of the infant's body and behind her back. The upper panel extends to form a necked-down panel of reduced width. The blanket is folded along the line of the necked-down panel with a lower panel of increased width being brought up and folded across the front of the infant. The opposing corners of the lower panel can then be wrapped around and behind the infant, leaving the infant snugly encapsulated within the multiple layers of the blanket with no excess accumulation or bagging of material or deficiency of material where needed which might otherwise be formed if the blanket were rectangular or another shape.

7 Claims, 1 Drawing Sheet

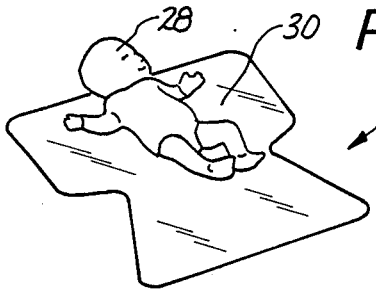
FIG. 1
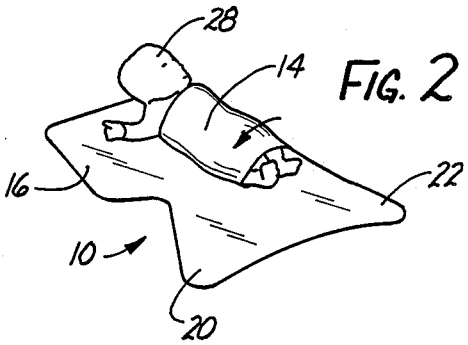
FIG. 2
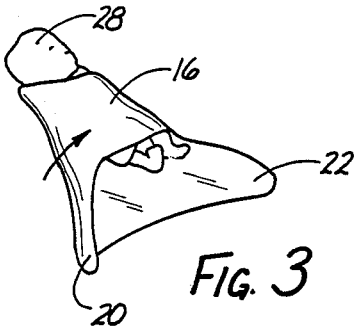
FIG. 3
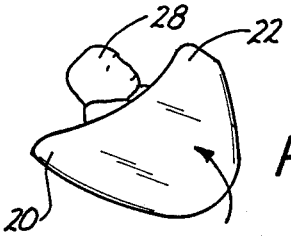
FIG. 4
FIG. 5
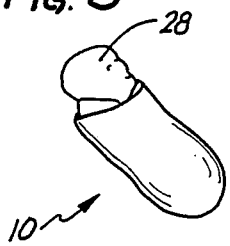
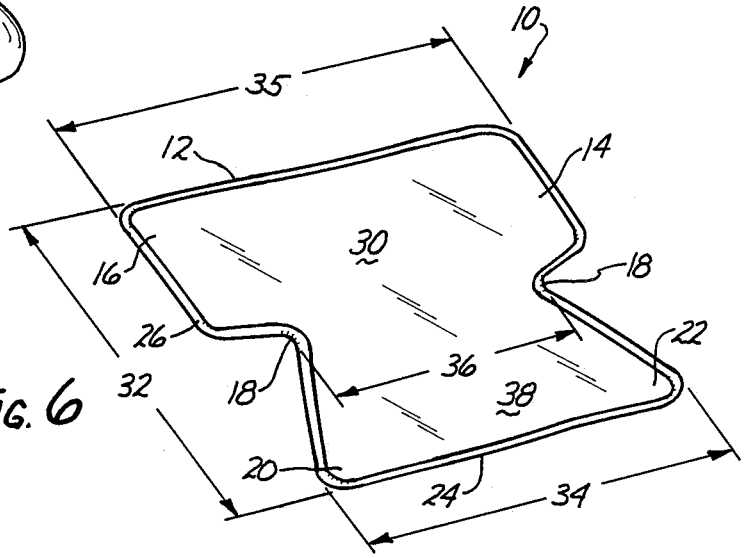
FIG. 6

BLANKET FOR A NEWBORN INFANT

BACKGROUND OF THE INVENTION

1. Field of the Invention

The invention relates to the field of blankets and in particular to blankets or articles of bedding for use with newborn infants.

2. Description of the Prior Art

Baby blankets are well known to the art and have been used perhaps from time immemorial to wrap or bundle a newborn infant. Typically, such blankets are simply odd sized remnants or pieces of blanketing material or bedding sheets, which are wrapped or wound about the newborn infant in the first hours and days after birth. In the modern era, blankets of approximately 35 inches by 27 inches are typically provided by hospitals or midwives for receiving the infant. The infant is then wrapped or wound in a blanket, which is of such a size as to have utility as an article of bedding only for a small newborn infant.

Snugly wrapping a newborn infant in a blanket to form a snug and somewhat confining cocoon about the infant's body is an effective way to thermally wrap and protect the newborn infant and to maintain the protective wrapping despite the newborn's involuntary arm and leg movements which might otherwise displace loose covers. It has recently come to be appreciated and documented that the snug cocoon-like wrapping is also believed to simulate the protective warmth, comfort and encapsulization within the mother's womb unconsciously remembered by the infant, or to which encapsulization the infant positively responds. Therefore, snug wrapping has come to be appreciated as having both physical and psychological benefits for the newborn infant.

However, considering the size of the typical infant blanket, many if not most mothers have difficulty in snugly wrapping their infants in a cocoon-like covering at all, or in a manner which can be maintained about the infant over a period of time as the infant involuntarily moves its arms and legs.

Therefore, what is needed is a blanket for a newborn infant which can be easily manipulated by the mother to securely and snugly wrap the newborn in a manner which can easily be remembered, effected and maintained by the mother or care provider.

BRIEF SUMMARY OF THE INVENTION

The invention is a blanket for an infant comprising an upper panel having a left and right wing. A necked-down panel is provided adjacent to the upper panel. The necked-down panel has a reduced width as compared to the width of the upper panel. A lower panel is provided adjacent the necked-down panel and has a width enlarged compared to the width of the necked-down panel.

As a result, a blanket is provided which can be easily manipulated to form a secure and snug wrapping around the infant.

The upper panel, necked-down panel and lower panel each have a common bisecting vertical axis and are each bilaterally symmetric about the bisecting vertical axis. The upper panel has a left and right lobe portion. The lower panel has a left and right lobe portion. In the illustrated embodiment, the upper panel, necked-down panel and lower panel form an integral sheet of soft fabric.

The blanket further comprises a smooth binding affixed to the edge of the blanket. The binding is satin and the panels are brushed flannel.

The left and right wing portions are arranged and configured to wrap over the shoulder and arm of an infant and to be tucked under the infant when the infant is approximately centered on the upper panel and laid approximately midway between the left and right wings.

The lower panel is arranged and configured to be folded upwardly toward the upper panel and under the chin of an infant laid in the center of the upper panel. The head of the infant extends above the upper panel and the feet of the infant extend towards the lower panel.

The left and right lobe portions of lower panel are arranged and configured to extend and be tucked under the infant when the infant is laid on the upper panel. The left and right wings are wrapped across the infant's shoulder and arms and the lower panel folded upwardly over the infant toward the upper panel and folded under the infant's head.

The invention is a blanket for an infant comprised of a sheet of soft fabric. The sheet is arranged and configured to have a vertical axis of bilateral symmetry. The infant is placed on the upper portion of the vertical axis when wrapped within the blanket. The sheet has an upper portion with left and right wings. Each of the wings has a shape and extent in order to be disposable over the infant when the infant is laid on the upper portion of the vertical axis. The wings substantially cover the body of the infant when the wings are wrapped over the shoulder and arm of the infant and further extend and are tucked underneath the back of the infant. The sheet further has a bottom portion folded up and over the infant when the wings are wrapped over and behind the infant. The bottom portion is arranged and configured to further extend over a substantial portion of the body of the infant and to be tucked underneath the infant when the infant is laid upon the upper portion of the vertical axis.

The invention is also a method of swaddling an infant in a blanket comprising the steps of providing: a blanket having an upper portion with left and right wings; a mid portion having a reduced width; and a lower portion of increased width as compared to the mid portion. The infant is laid approximately in the center of the upper portion of the blanket. One of the wing portions is folded over the infant's shoulder and arm. The wing portion just folded over the infant's shoulder and arm is tucked underneath the infant. The other one of the wing portions is then folded over the infant's shoulder and arm. The other wing portion just folded over the infant's shoulder and arm is then tucked beneath the infant. The bottom portion is folded up to the infant's chin, leaving the infant's head uncovered. Opposing corners of the bottom portion are tucked under the infant.

As a result, a soft warm complete enclosure of multiple layers of material is wrapped around the infant physically simulative of in utero containment of the infant.

The invention and its various embodiments are best visualized by turning now to the following drawings.

BRIEF DESCRIPTION OF THE DRAWINGS

FIG. 1 is a perspective view of the blanket incorporating the invention which has been laid out flatly and upon which a newborn infant has been placed in preparation for wrapping.

FIG. 2 is a perspective view of FIG. 1 after a first portion of the blanket has been wrapped.

FIG. 3 is a perspective view of FIG. 2 after a second portion of the blanket has been wrapped.

FIG. 4 is a perspective view of FIG. 3 after a third portion of blanket has been wrapped.

FIG. 5 is a perspective view of the infant after the final tucking and wrapping of the blanket.

FIG. 6 is a top plan view of the blanket laid out flatly.

The invention and its various embodiments may now be better understood by turning to the following detailed description.

DETAILED DESCRIPTION OF THE PREFERRED EMBODIMENTS

A blanket and method for swaddling an infant is provided that is both physically and psychologically simulative of the snug encapsulization experienced by the infant when in utero. The blanket is comprised of an upper portion having two symmetric wings. Each wing has a shape and a size sufficient to be wrapped over the shoulder and arm of the infant in front of the infant's body and behind her back. The upper panel extends to form a necked-down panel of reduced width. The blanket is folded along the line of the necked-down panel with a lower panel of increased width being brought up and folded across the front of the infant. The opposing corners of the lower panel can then be wrapped around and behing the infant, leaving the infant snugly encapsulated within the multiple layers of the blanket with no excess accumulation, bagging of material or deficiency of material where needed, which might otherwise be formed if the blanket were rectangular or another shape. The cut or design of the blanket facilitates the ability of the mother to swaddle or wrap the infant and to maintain the infant in a wrapped condition.

FIG. 6 shows a plan view of blanket 10 incorporating the invention. Blanket 10 is characterized in the illustrated embodiment as having a generally straight top edge 12 and two opposing lateral wings 14 and 16. Wings 14 and 16 narrow down to a midportion 18. Blanket 10 then flares outwardly again to form two bottom and symmetric lobes 20 and 22. Blanket 10 is then finished with a bottom, straight edge 24 which is generally parallel to top edge 12.

Blanket 10 may be comprised of a single layer or multiple layers of fabric and finished on its edge with a double stitched satin border 26. In the illustrated embodiment, the fabric which comprises blanket 10 is a soft, brushed flannel imprinted with an ornamental design.

It must be clearly understood that the precise details of the outline or shape of the blanket 10, the selection of finishings, edges and choice of material may be varied according to the teachings of the present invention without departing from the scope and spirit of the claims set forth below.

The general composition and shape of blanket 10 now having been described, consider its use as best depicted in FIGS. 1–5. FIG. 1 is a perspective view of blanket 10 of FIG. 6 wherein a newborn infant 28 has been laid onto the upper portion 30 of blanket 10. Infant 28 is laid on blanket 10 so that upper edge 12 lies beneath the infant's head or neck region. This will allow the infant's head to extend free of the covering of blanket 10 after the infant has been wrapped in the blanket. The infant is laid on blanket 10 along its longitudinal midline and approximately centered on upper portion 30. This will leave the buttocks of the infant normally positioned slightly above neck 18 of blanket 10.

In the preferred embodiment, the height 32 of blanket 10 is approximately 34 inches while width 34 of the lower panel is approximately 32 inches and width 35 of the upper panel is approximately 38 inches. The width 36 of the neck portion 18 is approximately 20.5 inches. These dimensions may be varied as desired in a manner consistent with the functionality of blanket 10 as described.

Turning to FIG. 2, after infant 28 has been centered and laid on upper portion 30 of blanket 10, one of wings 14 or 16 is then wrapped over and across the infant's shoulder and arm with its free end tucked underneath the infant's back. In the illustrated embodiment, wing 14 of FIG. 6 has been wrapped over infant 28 as shown in FIG. 2.

After wing 14 is thus snugged gently around and under infant 28, the opposing wing 16 is similarly folded across the other shoulder and arm of the infant and tucked securely under the infant's back as depicted in the perspective view of FIG. 3. The infant's body is now snugly wrapped around both sides, although the bottom is still open and the legs are left free.

The bottom panel, generally denoted by reference numeral 38, is then drawn up toward the baby's neck and folded over along a line or fold parallel to edge 24, if necessary, depending upon the length of the infant's body. In any case, the face, mouth and nose of the infant are left free and uncovered as best depicted in the perspective view of FIG. 4.

The baby is then lifted slightly and the extending ends of lobes 20 and 22 of bottom panel 38 are then gently, but snugly tucked under the infant's back, first on one side and then on the opposing side.

What results then is a secure cocoon-like wrapping as best depicted in FIG. 5. It may be readily appreciated at this point the infant has no less than three layers of blanket wrapping over the upper portion of the body, as seen when the infant is lying on its back. Furthermore, the wrapping completely encloses the infant's arms and legs and the fabric is tucked underneath the back of the infant, so that the involuntary movements which the infant makes do not cause the wrapping to become undone.

The infant is now snugly and securely wrapped in a soft, warm capsule which is psychologically and physically simulative of the containment and warmth provided to the infant while in utero. Not only are the physical needs of the infant for protection and warmth served, but also it is documented by health care professionals, that infants provided with the wrappings of blanket 10 as shown in FIGS. 1–6, tend to be calmer and generally more satisfied.

Blanket 10 of the invention is particularly advantageous over prior art rectangular blankets not only by being appropriately sized for the body of infant 28 according to how the infant is to be wrapped as shown in FIGS. 1–5, but also blanket 10 is sized and shaped to be easily manipulable by the mother, who can snugly fit the infant without special training when using the folding directions illustrated in FIGS. 1–5.

The contour of wings 14 and 16, neck 20 and bottom panel 38 are in positions which facilitate the concept of swaddling and provide immediate utility for the purpose of wrapping or swaddling an infant 28 without forming complex folds or creating unnecessary bunches of loose and non-functional fabric. Blanket 10, when folded as shown in FIGS. 1–5, provides just enough fabric for covering an infant in the right locations without the existence of excess material where unneeded or a deficiency of material where needed. The deficiency of material where need is a particular problem with prior art blankets which can be solved, if at all, only by laying the infant on a diagonal of the prior art blanket.

Many modifications and alterations may be made by those having ordinary skill in the art without departing from the spirit and scope of the invention. Therefore, the illustrated embodiment must be taken as being set forth only for the purposes of example and should not be taken as limiting the invention as defined in the following claims. For example, differences in the shape of the blanket from that illustrated in the drawings should not be construed as necessarily material differences when read in light of the claims.

We claim:

1. A blanket for swaddling an infant to simulate intra-uterine confinement comprising:

an upper panel having a left and right wing disposed under and behind the entire body of said infant, said left and right wings being arranged and configured to wrap over the shoulder and arm of an infant, across the chest of said infant and to be tucked under said infant when said infant is approximately centered on said upper panel and laid approximately midway between said left and right wings to substantially envelope the upper torso portion of said infant;

a necked-down panel adjacent to said upper panel, said necked-down panel having a reduced width as compared to the width of said upper panel; and a lower panel adjacent said necked-down panel having a width enlarged compared to said width of said necked-down panel, said lower panel having a left and right lobe portion, wherein said lower panel is arranged and configured to be folded upwardly toward said upper panel and under the chin of an infant laid in the center of said upper panel thereby covering the entire body of said infant, the head of said infant extending away from said upper panel and the feet of said infant extending towards said lower panel, said upper panel, necked-down panel and lower panel each have a common bisecting vertical axis and are each bilaterally symmetric about said bisecting vertical axis, said necked down portion positioned proximate the feet of said infant so that when so that when said lower panel is folded upwardly over said infant a pliant confinement of said infant's leg and feet is effected without creation of a space to permit unconfined movement, whereby a blanket is provided which can be easily manipulated to form a secure and snug wrapping around said infant.

2. A blanket for an infant to simulate prenatal uterine confinement and to promote prenatal behaviors comprised of a sheet of soft fabric, said sheet arranged and configured to have a vertical axis of bilateral symmetry, said infant being placed on the upper portion of said vertical axis and wrapped within said blanket, said sheet having an upper portion with left and right wings, each of said wings having a shape and extent disposed over said infant with said infant is laid on said upper protion of said vertical axis, said wings substantially covering the body of said infant and wrapped over said shoulder and arm of said infant and further extending and tucked underneath the back of said infant to pliantly confine the upper body of said infant, said sheet further having a bottom portion folded up and over said infant with said wings wrapped over and behind said infant, said bottom portion arranged and configured to further extend over a substantial portion of said body of said infant and tucked underneath said infant with said infant laid upon said upper portion of said vertical axis and folded on a narrowed portion of said blanket to pliantly confine the lower body of said infant.

3. The blanket of claim 2 wherein said bottom portion of said sheet is particularly arranged and configured to have two symmetric lobes, each lobe for extending over and around the body and shoulder of said infant and to be tucked underneath said infant.

4. A method of swaddling an infant in a blanket comprising the steps of:

providing a blanket having an upper portion with left and right wings, a mid portion having a reduced width and a lower portion of increased width as compared to said mid portion;

laying said infant approximately in the center of said upper portion of said blanket;

folding one of said wing portions over said infant's shoulder and arm;

tucking said wing portion just folded over said infant's shoulder and arm underneath said infant;

folding said other one of said wing portion over said infant's shoulder and arm;

tucking said other wing portion just folded over said infant's shoulder and arm beneath said infant;

folding said bottom portion up to said infant's body, leaving said infant's head uncovered; and tucking opposing corners of said bottom portion under said infant, whereby a soft warm complete enclosure of multiple layers of material is wrapped around said infant physically simulative of in utero containment of said infant.

5. The method of claim 4 where in said step of providing said blanket, a blanket of soft brushed flannel is provided.

6. The method of claim 5 where in said step of providing said blanket, a blanket having a smooth satin binding attached to its perimeter is provided.

7. An improvement in a blanket for swaddling an infant comprising an upper portion with left and right wings, a mid portion having a reduced width and a lower portion of increased width as compared to said mid portion, said infant laying approximately in the center of said upper portion of said blanket, said improvement comprising:

means for folding one of said wing portions over said infant's shoulder and arm, means tucking said wing portion just folded over said infant's shoulder and arm underneath said infant;

means for folding said other one of said wing portion over said infant's shoulder and arm;

means for tucking said other wing portion just folded over said infant's shoulder and arm beneath said infant;

means for folding said bottom portion up to said infant's body, leaving said infant's head uncovered; and means for tucking opposing corners of said bottom portion under said infant, whereby a soft warm complete enclosure of multiple layers of material is wrapped around said infant physically simulative of in utero containment of said infant.

* * * * *